US008818223B2

(12) United States Patent
Matsuo et al.

(10) Patent No.: US 8,818,223 B2
(45) Date of Patent: Aug. 26, 2014

(54) IMAGE FORMING APPARATUS AND IMAGE FORMING METHOD

(75) Inventors: Ryohei Matsuo, Toyokawa (JP); Toshiya Aoki, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 58 days.

(21) Appl. No.: 13/526,196

(22) Filed: Jun. 18, 2012

(65) Prior Publication Data

US 2012/0328317 A1 Dec. 27, 2012

(30) Foreign Application Priority Data

Jun. 22, 2011 (JP) ..... 2011-138039

(51) Int. Cl.
*G03G 15/20* (2006.01)
*G03G 15/00* (2006.01)

(52) U.S. Cl.
CPC .... *G03G 15/657* (2013.01); *G03G 2215/00599* (2013.01); *G03G 2215/0132* (2013.01); *G03G 2215/00945* (2013.01); *G03G 2215/00949* (2013.01); *G03G 15/2078* (2013.01)
USPC ..... 399/68; 399/70; 399/400

(58) Field of Classification Search
CPC ..... G03G 15/2078; G03G 15/657; G03G 2215/2045; G03G 2215/00949; G03G 2215/00945; G03G 2215/00599
USPC ..... 399/67–70, 400
See application file for complete search history.

(56) References Cited

U.S. PATENT DOCUMENTS 7,336,405 B2 * 2/2008 Dan ..... 358/503
7,606,509 B2 * 10/2009 Yako ..... 399/68
2009/0060561 A1 3/2009 Okabayashi

FOREIGN PATENT DOCUMENTS

| | | |
|---|---|---|
| JP | 4-181980 | 6/1992 |
| JP | 5-100600 | 4/1993 |
| JP | 6-317997 | 11/1994 |
| JP | 2005-99373 | 4/2005 |
| JP | 2007-183686 | 7/2007 |
| JP | 2008-102279 | 5/2008 |
| JP | 2009-37077 | 2/2009 |
| JP | 2009-58773 | 3/2009 |
| JP | 2009-180755 | 8/2009 |
| JP | 2009-265154 | 11/2009 |
| JP | 2009-276549 | 11/2009 |

OTHER PUBLICATIONS

Machine Translation of Japanese Reference 06-317997. Published Nov. 15, 1994.*

(Continued)

*Primary Examiner* — David Gray
*Assistant Examiner* — Carla Therrien
(74) *Attorney, Agent, or Firm* — Holtz, Holtz, Goodman & Chick PC

(57) ABSTRACT

An image forming apparatus includes an image forming section, a heat source, a fixing rotating body, a pressurizing rotating body, a feeding section for feeding a medium, a temperature adjusting section for controlling an amount of heat generated by the heat source, and a control section. The control section switches between a first mode in which the fixing rotating body and the pressurizing rotating body rotate at a first circumferential speed and the medium is fed to the image forming section at a first distance interval, and a second mode in which the fixing rotating body and the pressurizing rotating body rotate at a second circumferential speed higher than the first circumferential speed and the medium is fed to the image forming section at a second distance interval longer than the first distance interval.

14 Claims, 9 Drawing Sheets

(56) References Cited

OTHER PUBLICATIONS

Partial Translation of Japanese Reference 06-317997. Published Nov. 15, 1994.*

Notice of Groups of Rejection mailed Aug. 6, 2013, directed to JP Application No. 2011-138039; 7 pages.

* cited by examiner

IMAGE FORMING APPARATUS AND IMAGE FORMING METHOD

This application is based on Japanese Patent Application No. 2011-138039 filed with the Japan Patent Office on Jun. 22, 2011, the entire content of which is hereby incorporated by reference.

BACKGROUND OF THE INVENTION

1. Field of the Invention

The present invention relates to an image forming apparatus mounting a fixing device used for an electrophotographic image forming process, as well as to an image forming method.

2. Description of the Related Art

In a general electrophotographic image forming process, a toner image formed on a medium (e.g. sheet) is heated and pressed, so that the image is fixed. A fixing device for fixing the toner image in this manner typically has a heating roller as a heating rotating body and a pressure roller as a pressurizing rotating body. The heating roller is heated by a heat source such as a heater.

In such a fixing device, in order to have a not-yet-fixed toner image fixed on the medium, surface temperature of the heating roller must be maintained at a prescribed value. The surface temperature of the heating roller, however, decreases because of heat transfer, for example, from the surface of heating roller to the medium. Therefore, the surface temperature of heating roller is detected using a temperature sensor such as a thermistor, and based on the result of detection, the heat source is controlled such that the surface temperature of heating roller is maintained at the prescribed value.

Further, the pressure roller that rotates in coordination with the heating roller also has its surface temperature decreased, as it is deprived of heat as sheets as media are fed. If images are formed continuously on a plurality of media (when sheets are fed continuously), the temperature of pressure roller decreases significantly, resulting in undesirably tight curl of the medium or a low-temperature offset. Such influence is more evident in a low temperature environment.

As a countermeasure to such a curl or low-temperature offset derived from decrease in surface temperature of pressure roller, sometimes an arrangement is used in which the surface temperature of pressure roller is detected by using a temperature sensor such as a thermistor and based on the result of detection, the pressure roller is heated using a heat source such as a heater. Alternatively, methods such as making longer the warm-up period immediately after activation, increasing a set value or values related to temperature control, and reducing yield immediately after activation are sometimes used to reduce decrease of the surface temperature of pressure roller and thereby to maintain good fixing characteristic.

Specifically, by making longer the warm-up period immediately after activation, heat can be accumulated in the pressure roller, so that drop of surface temperature of the pressure roller can be reduced. By increasing the set value or values related to temperature control, fixing characteristic can be improved. Further, by reducing yield immediately after activation, time interval of feeding media becomes longer, so that the pressure roller can be heated while the medium is not fed and, hence, the surface temperature drop of pressure roller can be reduced.

The following prior art references related to such temperature control of fixing devices have been known.

Japanese Laid-Open Patent Publication No. 2009-276549 discloses an arrangement having an auxiliary heater which is electrically conducted only at the time of warm-up until the fixing roller in a low-temperature state reaches a prescribed fixing temperature.

Japanese Laid-Open Patent Publication No. 2009-058773 discloses an arrangement in which paper feed interval is made wider immediately after activation if degree of humidity is high.

Japanese Laid-Open Patent Publication No. 2005-099373 discloses an arrangement in which, when the degree of humidity is low, warm-up is continued until that one of fixing members which has higher rate of temperature increase reaches a prescribed temperature, and when the degree of humidity is high, additional warm-up for a prescribed time period takes place after the fixing member which has higher rate of temperature increase reached a prescribed temperature. The additional warm-up is continued until timer-count ends, or until that one of the fixing members which has lower rate of temperature increase reaches a prescribed temperature.

Japanese Laid-Open Patent Publication No. 2009-265154 discloses an arrangement in which, at the time of warm-up after power on or at the time of returning from sleep mode for saving power consumption, if printing of sheets is received with the operation mode set to a normal mode, speed of printing at the fixing roller is set lower than the normally set speed generally set in the normal mode and the set temperature for fixing for the fixing roller is set lower than the normally set temperature generally set in the normal mode, printing operation is started and, when the fixing temperature reaches the normally set temperature, the speed of printing at the fixing roller is set to the normally set speed.

Japanese Laid-Open Patent Publication No. 2009-180755 discloses an arrangement in which speed of rotation of the fixing roller in the warm-up period can be set to two or more speeds of rotation and, based on a degree of humidity detected by a humidity sensor, the speed of rotation of the fixing roller in the warm-up period is set to one of the two or more speeds of rotation, such that the speed of rotation becomes higher if the detected degree of humidity is higher.

Japanese Laid-Open Patent Publication No. 2009-037077 discloses an arrangement having humidity detecting means for detecting environmental humidity of ambient surrounding, in which speed of rotation of the pressure roller during warm-up operation is changed based on the degree of humidity detected by the humidity detecting means.

Japanese Laid-Open Patent Publication No. 2008-102279 discloses control of rotation number at the time of warm-up based on temperature and humidity. More specifically, when the degree of humidity is low, rotation of the fixing roller is made slower, and if the temperature is high, rotation of the fixing roller is made slower.

Japanese Laid-Open Patent Publication No. 2007-183686 discloses a method of reducing temperature drop of the fixing roller by changing interval of paper feed.

The above-described methods of making longer the warm-up period immediately after activation, increasing set values related to temperature control and reducing yield immediately after activation have much influence on the user. Specifically, the method of making longer the warm-up period immediately after activation may require excessively long time to increase the temperature of pressure roller unless the pressure roller can be heated with high efficiency. The method of increasing set values related to temperature control increases thermal energy consumption. Further, the method of reducing yield immediately after activation leads to waste of time of the user.

SUMMARY OF THE INVENTION

The present invention was made to solve the above-described problems, and its object is to provide image forming apparatus and image forming method enabling execution of more stable fixing process while reducing undesirable influence to the user such as lower yield.

According to an aspect, the present invention provides an image forming apparatus, including: an image forming section for forming a toner image on a medium; a heat source; a fixing rotating body receiving heat supplied from the heat source; a pressurizing rotating body adapted to form a nip portion with the fixing rotating body; a feeding section for feeding the medium at a speed synchronized with circumferential speed of the fixing rotating body and the pressurizing rotating body, so that the medium having the toner image formed thereon passes through the nip portion; a temperature adjusting section for controlling an amount of heat generated by the heat source so that temperature of the fixing rotating body attains to a prescribed value; and a control section for switching between a first mode in which the fixing rotating body and the pressurizing rotating body rotate at a first circumferential speed and the medium is fed to the image forming section at a first distance interval, and a second mode in which the fixing rotating body and the pressurizing rotating body rotate at a second circumferential speed higher than the first circumferential speed and the medium is fed to the image forming section at a second distance interval longer than the first distance interval.

Preferably, the control section selects the second mode in response to switching of the heat source from a state not generating any heat to a heat generating state.

More preferably, the control section switches to the first mode a prescribed time period after selection of the second mode.

More preferably, the control section selects the first mode even if the heat source is switched to the heat generating state, as long as ambient temperature of the image forming apparatus is at a prescribed value or higher.

Preferably, the image forming apparatus further includes a temperature measuring section for measuring temperature of the pressurizing rotating body, and the control section selects the second mode if the temperature of the pressurizing rotating body is lower than a prescribed value.

More preferably, after selecting the second mode, if the temperature of the pressurizing rotating body attains to the prescribed value or higher, the control section switches to the first mode.

According to another aspect, the present invention provides an image forming method of forming a toner image on a medium, including the steps of: forming a toner image on the medium; feeding the medium with the toner image formed thereon, at a speed synchronized with circumferential speed of a fixing rotating body and a pressurizing rotating body, to be passed through a nip portion formed between the pressurizing rotating body and the fixing rotating body receiving heat supplied from a heat source; controlling an amount of heat generated by the heat source so that temperature of the fixing rotating body attains to a prescribed value; and switching between a first mode in which the fixing rotating body and the pressurizing rotating body rotate at a first circumferential speed and the medium is fed to an image forming section at a first distance interval, and a second mode in which the fixing rotating body and the pressurizing rotating body rotate at a second circumferential speed higher than the first circumferential speed and the medium is fed to the image forming section at a second distance interval longer than the first distance interval.

Preferably, the step of switching includes the step of selecting the second mode in response to the heat source being switched from a state not generating any heat to a heat generating state.

More preferably, the step of switching includes the step of switching to the first mode a prescribed time period after selection of the second mode.

Preferably, the step of switching includes the step of selecting the first mode even if the heat source is switched to the heat generating state, as long as ambient temperature of the image forming apparatus is at a prescribed value or higher.

Preferably, the image forming method further includes the step of measuring temperature of the pressurizing rotating body, and the step of switching includes the step of selecting the second mode if the temperature of the pressurizing rotating body is lower than a prescribed value.

More preferably, the step of switching includes the step of switching to the first mode, after selecting the second mode, if the temperature of the pressurizing rotating body attains to the prescribed value or higher.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
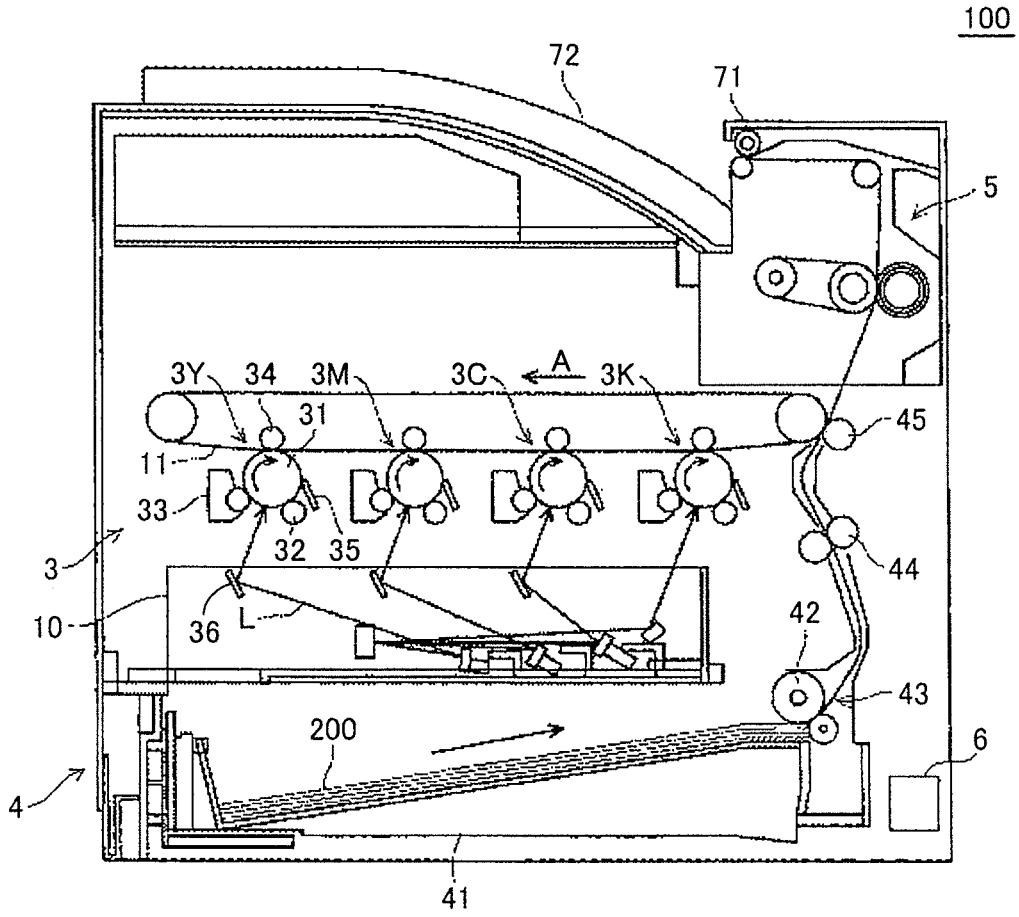
FIG. 1 shows a schematic configuration of an image forming apparatus in accordance with an embodiment of the present invention.

An embodiment of the present invention will be described in detail with reference to the figures. The same or corresponding portions in the figures are denoted by the same reference characters, and description thereof will not be repeated.

[A. Outline]

The fixing device in accordance with the present embodiment includes: a heating roller having a heater as a heat source, supported rotatably at opposite ends; an endless fixing belt wound around a rotatably supported fixing roller; and a rotationally driven pressure roller, in contact with an outer circumference of the fixing belt, applying load to the fixing roller to form a nip portion. The fixing roller is rotatably attached to a side plate, and the belt is spanned with tension by means of a compression spring provided between the side plate and a heating roller supporting member. Thus, when the pressure roller is driven, the fixing belt and the fixing roller follow.

Typically, before executing warm-up control after power on, system speed related to the warm-up control is determined. In a low temperature environment, the system speed is set higher than in a normal environment. When the warm-up control starts, the pressure roller is driven at the determined system speed. When the warm-up control is completed and a print job is received, printing is done with sheet-to-sheet distance sufficient to maintain yield, in accordance with the set system speed.

For a prescribed time period after the start of warm-up control, the set system speed is maintained. After the lapse of the prescribed time period, the temperature of pressure roller has been increased and, therefore, the system speed for the normal environment is selected and the sheet-to-sheet distance is set to be shorter, to maintain yield.

[B. Overall Configuration of the Apparatus]

First, configuration of an image forming apparatus 100 in accordance with the present embodiment will be described. Image forming apparatus 100 in accordance with the present embodiment may be used for any purpose, provided that it executes the electrophotographic image forming process. Specifically, image forming apparatus 100 may be implemented as a printer, a copy machine, a facsimile, or a multifunctional peripheral (MFP). In the following, an example will be described in which image forming apparatus 100 is implemented as a printer.

FIG. 1 shows a schematic configuration of image forming apparatus 100 in accordance with an embodiment of the present invention. Referring to FIG. 1, image forming apparatus 100 represents, as an example, a color printer having a tandem type print engine. Image forming apparatus 100 includes, as main components, an image forming unit 3, a paper feed unit 4, a fixing device 5 and a controller 6.

Image forming unit 3 corresponds to an image forming section for forming a toner image on a medium (e.g. sheet 200), and it includes image forming units 3Y, 3M, 3C and 3K respectively forming toner images of yellow (Y), magenta (M), cyan (C) and black (BK). These image forming units 3Y, 3M, 3C and 3K are arranged in the order of Y→M→C→BK from the upstream side, along an intermediate transfer belt circulating in the direction indicated by arrow A in FIG. 1.

Each of image forming units 3Y, 3M, 3C and 3K has a photoreceptor drum 31. On photoreceptor drum 31, a toner image of the corresponding color (single color) is developed, and the developed toner image of each color is transferred to intermediate transfer belt 11 by a primary transfer roller 34 at a position of contact between the corresponding image forming unit 3 and intermediate transfer belt 11. The positions of toner image transfer by image forming units 3Y, 3M, 3C and 3K are synchronized with each other and, therefore, as intermediate transfer belt 11 passes through image forming units 3Y, 3M, 3C and 3K, respectively, toner images of respective colors are successively placed one after another and, eventually, a full-color toner image is formed on intermediate transfer belt 11.

More specifically, each of image forming units 3Y, 3M, 3C and 3K includes a charging section 32 for uniformly charging photoreceptor drum 31, and a developing section 33 for developing an electrostatic latent image formed by exposing the surface of photoreceptor drum 31 with light of a color corresponding to the image to be reproduced with the toner of the corresponding color. The toner image developed by a series of operations of these members is transferred, as primary transfer, to intermediate transfer belt 11. Exposure of photoreceptor drum 31 is done by an exposure controller 10. Exposure controller 10 receives a command in accordance with a print job or the like, applied from controller 6. The toner left on photoreceptor drum 31 after the primary transfer is removed by a cleaning section 35 arranged on the downstream side, and recovered to a waste toner container or the like, not shown.

The full-color toner image formed on intermediate transfer belt 11 is transferred as a whole to a sheet 200 as the medium, by a secondary transfer roller 45 arranged on the downstream side. Further, sheet 200 with the toner image transferred thereon passes through fixing device 5 provided on the downstream side, whereby the transferred toner image is fixed. Finally, sheet 200 having the fixed toner image is conveyed by a paper discharge roller 71 and the like to be discharged to a paper discharge tray 72. Details of fixing device 5 will be described later.

Sheets 200 are typically contained in a paper feed cassette 41 of paper feed unit 4 provided at a lower part of the apparatus, and the sheets are fed one by one from paper feed cassette 41 to secondary transfer roller 45. On a conveying path 43 from paper feed cassette 41 to secondary transfer roller 45, a paper feed roller 42, a conveyer roller 44 and the like are provided.

The toner left on intermediate transfer belt 11 after the secondary transfer is removed by a cleaning blade, not shown, from intermediate transfer belt 11, and recovered to a waste toner container or the like, not shown.

Controller 6 controls image forming apparatus 100 as a whole. Specifically, controller 6 controls exposure controller 10, image forming unit 3, conveying means for sheet 200 and the like, to realize the control related to image formation in accordance with the present embodiment, as will be described later.

Controller 6 mainly includes a CPU (Central Processing Unit) as a processing section, an RAM (Random Access Memory), an ROM (Read Only Memory), an EEPROM (Electrically Erasable and Programmable Read Only Memory) and an HDD (Hard Disk Drive) as storage sections. Though control functions of controller 6 are typically realized by the CPU executing programs, part of or all of the control functions may be implemented by dedicated hardware or an LSI (Large Scale Integration).

The image forming apparatus in accordance with the present invention is not limited to the one having such a configuration as shown in FIG. 1, and it may be appropriately modified as needed.

[C. Configuration of Fixing Device]

Next, more detailed configuration of fixing device 5 shown in FIG. 1 will be described.

Figure 2:
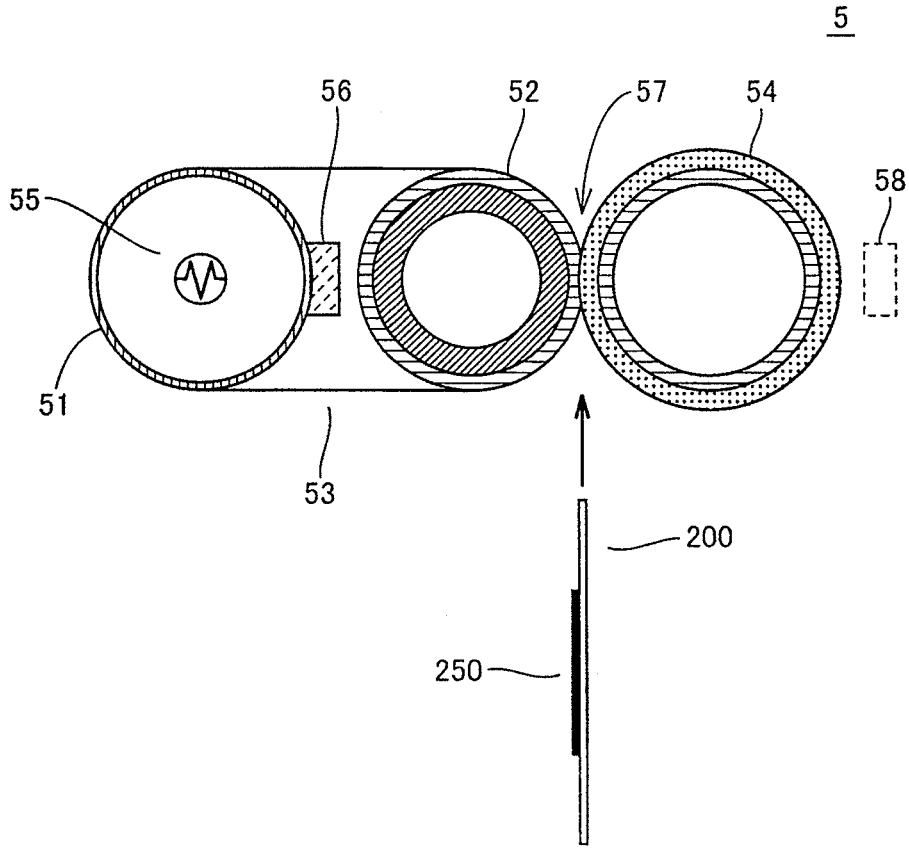
FIG. 2 shows a schematic configuration of the fixing device included in the image forming apparatus in accordance with an embodiment of the present invention.

FIG. 2 shows a schematic configuration of fixing device 5 included in image forming apparatus 100 in accordance with an embodiment of the present invention. Referring to FIG. 2, fixing device 5 includes a heating roller 51, a fixing roller 52 and a pressure roller 54.

Heating roller 51 has a heater 55 as a heat source therein. Heater 55 is typically a resistive element, generating heat using the heat generated by the supplied electric power consumed by the resistor. A heater utilizing electromagnetic induction may be used as heater 55.

Heating roller 51 is formed to have a rotation axis in the direction vertical to the sheet of drawing, and is rotatable. Fixing roller 52 is also formed to have a rotation axis in the direction vertical to the sheet of drawing, and is rotatable, similar to heating roller 51. Specifically, each of heating roller 51 and fixing roller 52 has opposite ends rotatably supported, with the rotation axis extending in the direction vertical to the sheet of drawing. Between heating roller 51 and fixing roller 52, fixing belt 53 is wound. Fixing roller 52 is rotatably attached to a side plate (not shown) extending parallel to the sheet, and between a support member of heating roller 51 and the side plate, a compression spring, not shown, is provided. Fixing belt 53 is spanned with tension applied by the compression spring.

The two rollers are rotated by fixing belt 53, so that heat is supplied from heating roller 51 (heater 55) as a heat source to fixing roller 52. Specifically, by the heat generated by heater 55, heating roller 51 is heated, fixing belt 53 in contact with the surface of heating roller 51 is heated, and as the heated fixing belt 53 rotates and comes to be in contact with the surface of fixing roller 52, the heat generated by heating roller 51 is transferred to fixing roller 52.

A temperature sensor 56 is provided in contact with or close to the surface of heating roller 51. Temperature sensor 56 measures the temperature (surface temperature) of heating roller 51. As temperature sensor 56, a thermistor, or a sensor measuring temperature with infrared ray may be used.

In fixing device 5, temperature is controlled based on the temperature measured by temperature sensor 56. Typically, the temperature measured by temperature sensor 56 is compared with a set value, to control on/off of power supply to heater 55. By such a temperature adjustment function, the temperature of heating roller 51 and fixing roller 52 is regulated to attain a prescribed set value (for example, 160° C.). Specifically, the temperature adjusting section mounted on image forming apparatus 100 controls the amount of heat generation of heater 55 as the heat source such that the temperature of fixing roller 52 as the fixing rotating body attains to a prescribed value.

Fixing roller 52 is in pressure contact with pressure roller 54, and between fixing roller 52 and pressure roller 54, fixing belt 53 is pinched. By such an arrangement, the contact portion between fixing belt 53 and pressure roller 54 form a nip portion 57. Specifically, pressure roller 54 as the pressurizing rotating body is configured to form a nip portion 57 with fixing roller 52 as the fixing rotating body.

The three rollers forming fixing device 5 (heating roller 51, fixing roller 52 and pressure roller 54) rotate at a prescribed speed while the image forming process is being executed. Typically, a driving motor, not shown, is linked to pressure roller 54, and when pressure roller 54 is driven by the driving motor and rotates, fixing belt 53, fixing roller 52 and heating roller 51 are driven and rotate followingly. While these rollers and fixing belt 53 rotate, all circumferences are heated with fixing belt 53 serving as a medium. The temperature increasing operation continues until the temperature of fixing roller 52 attains to the prescribed value. In the following example, it is assumed that pressure roller 54 rotates at a surface speed (circumferential speed) of 110 mm/s in a normal environment.

When fixing roller 52 and fixing belt 53 are heated to the prescribed temperature, a medium (e.g. sheet 200) having a toner image 250 (not-yet-fixed) transferred from intermediate transfer belt 11 enters nip portion 57. While sheet 200 passes through nip portion 57, the not-yet-fixed toner image 250 formed on its surface is fixed by the applied heat and pressure, on sheet 200. As described above, image forming apparatus 100 has conveying means (such as conveyer roller 44 shown in FIG. 1) for conveying the medium (e.g. sheet 200), and the conveying means conveys the medium having toner image 250 formed thereon at a speed synchronized with the circumferential speed of fixing roller 52 (fixing rotating body) and pressure roller 54 (pressurizing rotating body) and passes the medium through nip portion 57.

A temperature sensor 58 for measuring temperature (surface temperature) of pressure roller 54 may be additionally provided. Temperature sensor 58 is provided in contact with or close to the surface of pressure roller 54. As temperature sensor 58, a thermistor, or a sensor measuring temperature with infrared ray may be used. The temperature measured by temperature sensor 58 may be used for controlling speed of rotation (circumferential speed) of pressure roller 54, as will be described later. In this manner, image forming apparatus 100 may include a temperature measuring section for measuring the temperature of pressure roller 54 as the pressurizing rotating body.

Specifications of fixing device 5 used in various tests as will be described later are as follows.

Heating roller 51 has a metal core formed of aluminum having outer diameter of 30 mm and thickness of 0.5 mm, with its surface coated with PTFE (Polytetrafluoroethylene). Amount of heat generated by heater 55 is 1000 W.

Fixing roller 52 has a metal core of iron having outer diameter of 18 mm, and has an elastic layer of silicone rubber having the thickness of 4 mm and silicone sponge having the thickness of 2 mm on its surface and, therefore, outer diameter of fixing roller 52 as a whole is 30 mm.

On a surface of fixing belt 53, a nickel layer of 35 μm in thickness, an elastic layer of silicone rubber of 200 μm in thickness, and a surface layer of PFA (tetrafluoroethylene perfluoro alkyl vinyl ether copolymer) tube of 20 μm in thickness are formed, and outer diameter of fixing belt 53 as a whole is 60 mm.

Pressure roller 54 has a metal core of iron having the thickness of 2.5 mm, and has an elastic layer of silicone rubber of 2.5 mm in thickness and a PFA tube of 30 μm thickness formed thereon. The outer diameter of pressure roller 54 as a whole is 35 mm.

The nip load at nip portion 57 is 50 to 450 N, nip width is about 9 mm, and width in the longitudinal direction of the nip is about 320 mm.

The set value for the temperature adjustment function based on temperature sensor 56 is 160° C.

Regarding the heater, heater orientation is 115%-100%-115%, and emission length is 20 mm-250 mm-20 mm. Specifically, in order to ensure sufficient fixing characteristic at end portions, orientation at end portions of the heater is made higher. Regarding the pressure roller, the orientation is 100% and emission length is 290 mm.

Fixing device 5 is not limited to the example having the above-described specifications, and the device may be modified appropriately.

[D. Temperature Characteristics of Fixing Device]

Prior to the description of control function in accordance with the present embodiment, temperature characteristics of fixing device 5 will be described.

As described with reference to FIG. 2, fixing device 5 detects surface temperature of heating roller 51, and based on the result of detection, controls heater 55 as the heat source, so that the surface temperature of heating roller 51 is kept at a prescribed value. Pressure roller 54 that rotates in coordination with heating roller 51 also has its surface temperature decreased as it is deprived of heat as a medium (e.g. sheet 200) is fed. When images are continuously formed on a plurality of media (when sheets are fed continuously), the temperature of pressure roller 54 decreases significantly, resulting in tight curl of sheet 200 or low-temperature offset. Such an influence is more strongly felt in a low-temperature environment.

When paper is fed continuously while the apparatus as a whole is cold, for example, immediately after opening time on Monday morning, the surface temperature of pressure roller 54 drops significantly and, according to an experiment made by the inventors, the fixing characteristic degrades most significantly on the tenth to twentieth sheets. Such degradation of fixing characteristic tends to be severer in a low-temperature environment.

The reason why the surface temperature of pressure roller drops is that heat from the heating side (heating roller 51 and fixing roller 52) cannot sufficiently be transferred to the pressurizing side (pressure roller 54), since the distance between a preceding sheet and a succeeding sheet (sheet-to-sheet distance) is too short during continuous paper feeding. Specifically, under the condition of maintaining constant system speed (printing yield), the problem of surface temperature drop of pressure roller 54 tends to occur.

Figure 3A:
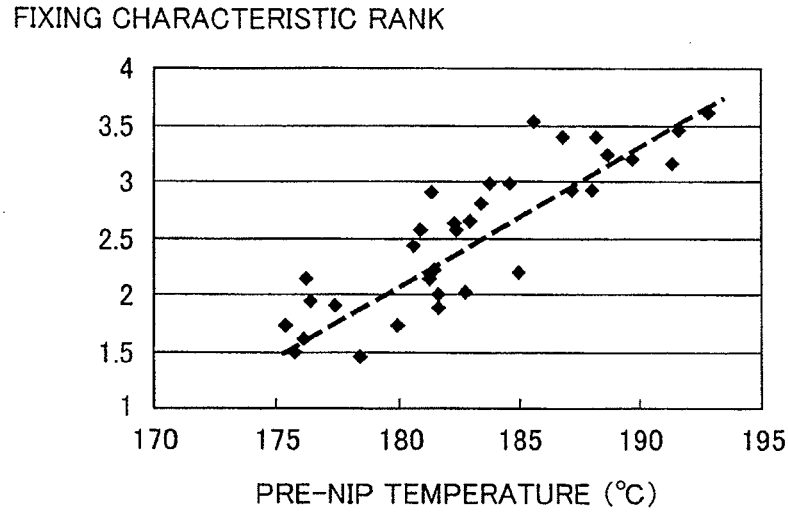
FIGS. 3A to 3C show examples of test results related to temperature characteristics of the fixing device in the image forming apparatus in accordance with an embodiment of the present invention.
Figure 3B:
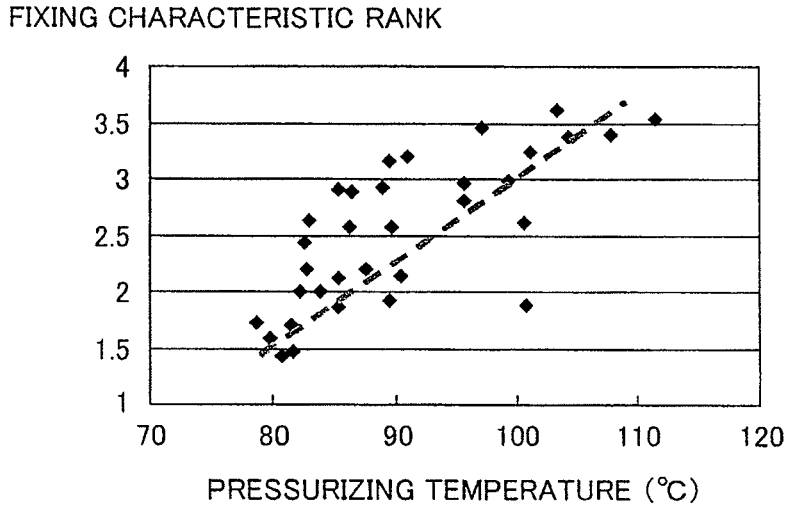
Figure 3C:
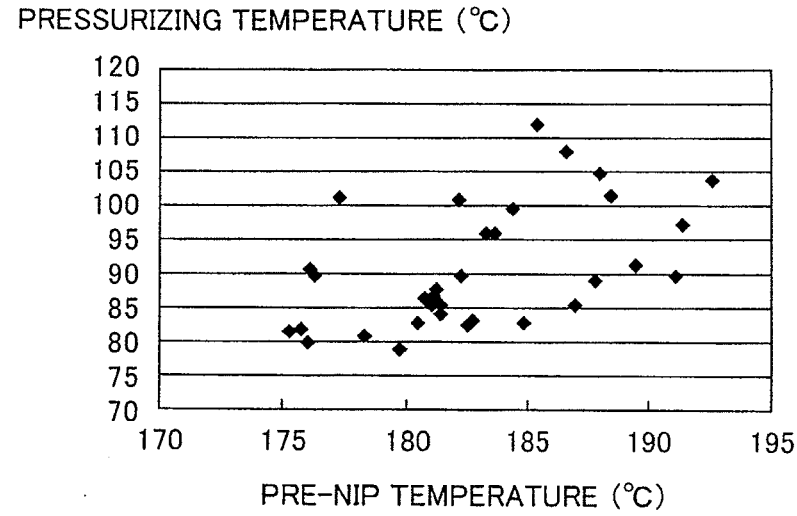

FIGS. 3A to 3C show examples of test results related to temperature characteristics of fixing device 5 in image forming apparatus 100 in accordance with the present embodiment. FIG. 3A plots a relation between the temperature of fixing belt 53 before entering nip portion 57 (pre-nip temperature) and fixing characteristic of printed sheet 200. For the evaluation of fixing characteristic on sheet 200, an index referred to as "fixing characteristic rank" is used. The "fixing characteristic rank" indicates the degree of fixing of toner image 250. FIG. 3B plots a relation between the surface temperature (pressurizing temperature) of pressure roller 54 and fixing characteristic (fixing characteristic level) of printed sheet 200. FIG. 3C plots a relation between the temperature of fixing belt 53 before entering nip portion 57 and the surface temperature (pressurizing temperature) of pressure roller 54.

As shown in FIG. 3A, fixing characteristic of toner image 250 formed on sheet 200 has strong correlation to the temperature (pre-nip temperature) of fixing belt 53, and it can be seen that higher fixing characteristic can be attained when the temperature of fixing belt 53 is higher. Further, as shown in FIG. 3B, the fixing characteristic of toner image 250 formed on sheet 200 also has a correlation with the surface temperature of pressure roller 54 (pressurizing temperature), and it can be seen that higher fixing characteristic can be attained when the surface temperature of pressure roller 54 is higher.

From the test results shown in FIGS. 3A and 3B, it can be understood that fixing characteristic degrades when the temperature of fixing belt 53 and/or surface temperature of pressure roller 54 drops. Therefore, such temperature drop must be prevented as much as possible.

On the other hand, as can be seen from FIG. 3C, there is substantially no correlation between the temperature of fixing belt 53 and the surface temperature of pressure roller 54. The reason for this is that the amount of heat transferred from fixing roller 52 to pressure roller 54 much depends on the frequency of passing of media between fixing belt 53 and pressure roller 54 and not depends on the temperature of fixing belt 53 itself.

Specifically, unless sufficient interval between preceding and succeeding media (sheet-to-sheet distance) is ensured, the surface temperature of pressure roller 54 decreases, even if the set value of surface temperature of heating roller 51 is high. Namely, the surface temperature of pressure roller 54 is highly dependent on the sheet-to-sheet distance. Therefore, in an environment where the surface temperature of pressure roller 54 much contributes to the fixing characteristic (in a low-temperature or high-humidity environment), it is necessary to ensure sufficient sheet-to-sheet distance.

On the other hand, if the sheet-to-sheet distance is to be ensured with the system speed maintained constant, the yield decreases. The object of the present embodiment is to solve the problems of both the degradation of fixing characteristic and lower yield, which have been difficult to solve simultaneously by the conventional methods.

[E. Solution]

In order to prevent degradation of fixing characteristic and lower yield, in image forming apparatus 100 in accordance with the present embodiment, the system speed and the sheet-to-sheet distance are controlled such that the temperature of pressurizing side (pressure roller 54) is regulated while not excessively heating the heating side (heating roller 51 and fixing roller 52), so as to prevent the surface temperature drop of pressure roller 54 at the time of continuous paper feeding and to maintain yield.

Specifically, the control section mounted on image forming apparatus 100 switches operation between a first mode in which fixing roller 52 (fixing rotating body) and pressure roller 54 (pressurizing rotating body) are rotated at a first circumferential speed (system speed V1) and media (e.g. sheets 200) are supplied to image forming unit 3 as the image forming section at a first distance interval (sheet-to-sheet distance D1), and a second mode in which fixing roller 52 (fixing rotating body) and pressure roller 54 (pressurizing rotating body) are rotated at a second circumferential speed (system speed V2>system speed V1) and media (e.g. sheets 200) are supplied to image forming unit 3 as the image forming section at a second distance interval (sheet-to-sheet distance D2>sheet-to-sheet distance DD.

In the following, the change of system speed and the change of sheet-to-sheet distance as mentioned above will be described.

(e1. Temperature Increasing Effect by the Change of System Speed)

Figure 4:
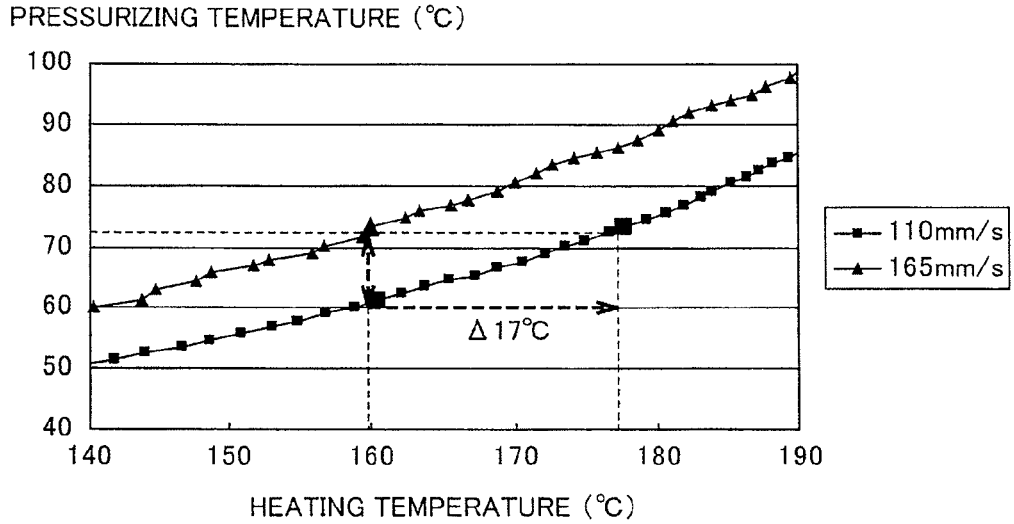
FIG. 4 shows an example of a test related to influence of system speed in the fixing device in the image forming apparatus in accordance with an embodiment of the present invention.

FIG. 4 shows results of experiment related to the influence of system speed on fixing device 5 in image forming apparatus 100 in accordance with the present embodiment. Specifically, FIG. 4 shows measurements of time-change in surface temperature of pressure roller 54 when the system speed is varied (system temperature: 110 mm/s and 165 mm/s), while set values related to temperature adjustment of the heating side (heating roller 51 and fixing roller 52) are kept constant. The abscissa represents the surface temperature of heating roller 51. The results shown in FIG. 4 are obtained during a warm-up operation from a low-temperature state.

Referring to FIG. 4, it can be seen that the surface temperature of pressure roller 54 attains to a higher temperature when the system speed is higher. If, for example, the print permitting temperature on the pressurizing side is 70° C. and the print permitting temperature on the heating side at a low-temperature state is 160° C., the temperature on the pressurizing side can be raised to 70° C. while maintaining constant the set values related to temperature adjustment on the heating side, by changing the system speed from 110 mm/s (normal) to 165 mm/s. Specifically, by increasing the system speed, the temperature conditions for starting the image forming process on the pressurizing side and the heating side can be satisfied.

In contrast, if the system speed is kept at 110 mm/s, the pressurizing side does not reach the print permitting temperature of 70° C. In order to raise the temperature of pressurizing side to the print permitting temperature of 70° C., it is necessary to increase the set values related to temperature adjustment on the heating side by about 17° C., and this change of set values leads to undesirable energy loss.

As described above, by increasing the system speed, it becomes possible to sufficiently transfer heat from the heating side (heating roller 51 and fixing roller 52) to the pressurizing side (pressure roller 54).

(e2: Change of Sheet-to-Sheet Distance with Change of System Speed)

In order to prevent the surface temperature drop of the pressure roller related to the change of system speed as described above, the interval between the preceding and succeeding media (sheet-to-sheet distance) is changed in coordination with the change of system speed. The amount of change of the sheet-to-sheet distance should preferably be the amount that can maintain substantially the same yield before and after the change of system speed. Specifically, the sheet-to-sheet distance is changed substantially in proportion to the system speed. Since the sheet-to-sheet distance is in proportion to the system speed, the number of prints per unit time can be maintained.

Figure 5:
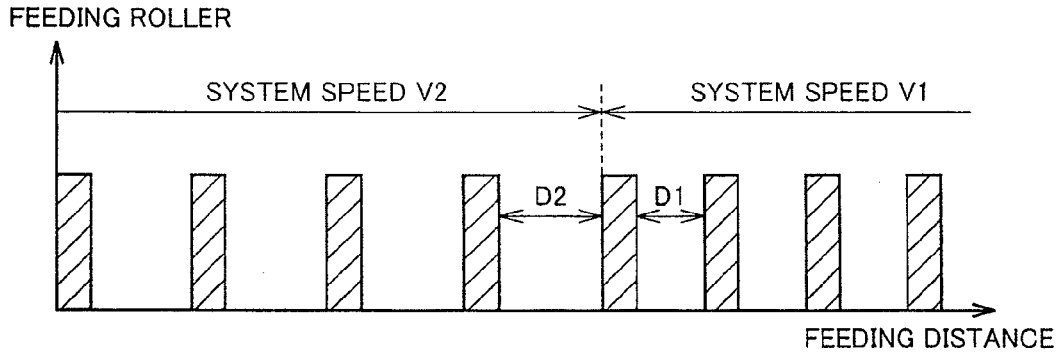
FIG. 5 shows a relation between sheet-to-sheet distance of medium and the system speed in the image forming apparatus in accordance with an embodiment of the present invention.
Figure 6:
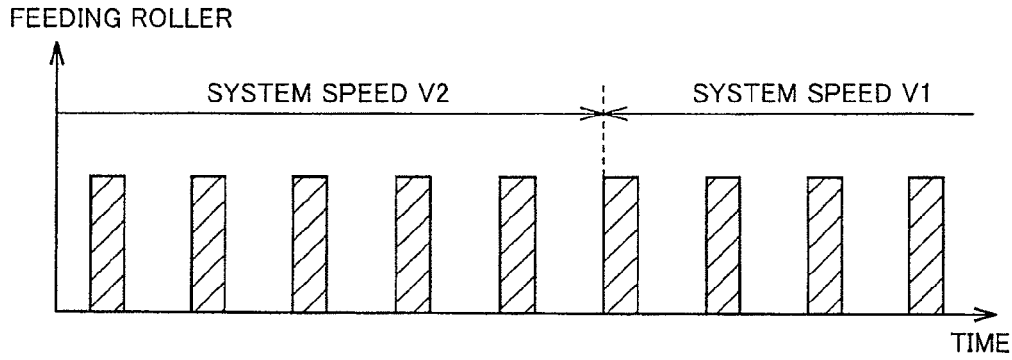
FIG. 6 shows a relation between feeding timing of medium and the system speed in the image forming apparatus in accordance with an embodiment of the present invention.

FIG. 5 shows a relation between the sheet-to-sheet distance of recording media and the system speed in image forming apparatus 100 in accordance with an embodiment of the present invention. FIG. 6 shows a relation between the feeding timing of media and the system speed in image forming apparatus 100 in accordance with the present embodiment.

As shown in FIG. 5, while the system speed is V1, the media are successively fed to image forming unit 3 at the sheet-to-sheet distance D1, and when the system speed is changed to V2, the sheet-to-sheet distance of feeding media to image forming unit 3 is made longer from D1 to D2.

Here, it is preferred that the relation of system speed V1: system speed V2=(length of medium+sheet-to-sheet distance D1):(length of medium+sheet-to-sheet distance D2) holds. If such a relation can be maintained, the time cycle of feeding the media to image forming unit 3 can be maintained constant, independent from the system speed, as shown in FIG. 6. Specifically, the number of prints output per unit time is constant and, therefore, the yield can be maintained.

As a specific example, assume that when the system speed is 110 mm/s, the yield of outputting A4 size plane paper is 23 sheets/min., and the sheet-to-sheet distance is set to 75 mm. If the system speed of 165 mm/s is selected, in order to maintain the yield of outputting A4 size plane paper of 23 sheets/min., the sheet-to-sheet distance is set to 220 mm.

By setting such sheet-to-sheet distance, the sheet-to-sheet distance that corresponds to the heating time period of pressure roller 54 becomes about 0.8 rounds (75 mm/(ϕ30×π)) if the system speed is 110 mm/s, and it becomes about 2.3 rounds (220 mm/(ϕ30×π)) if the system speed is 165 mm/s. Specifically, if the system speed of 165 mm/s is selected, it is possible to heat pressure roller 54 for about three times longer in sheet-to-sheet distance, than when the system speed is 110 mm/s.

As described above, since the contact distance of fixing belt 53 for heating pressure roller 54 becomes longer, the surface temperature drop of pressure roller 54 during continuous paper feed can be reduced.

(e3: Example 1)

An example using the control logic as above will be described.

Figure 7A:
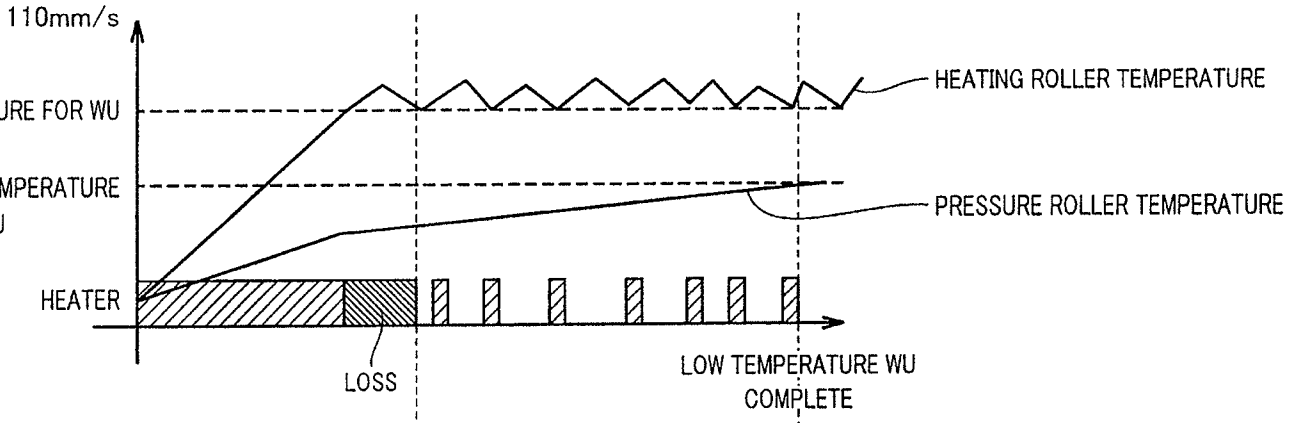
FIGS. 7A and 7B show simulation examples comparing the control method in accordance with an embodiment of the present invention with a conventional control method.
Figure 7B:
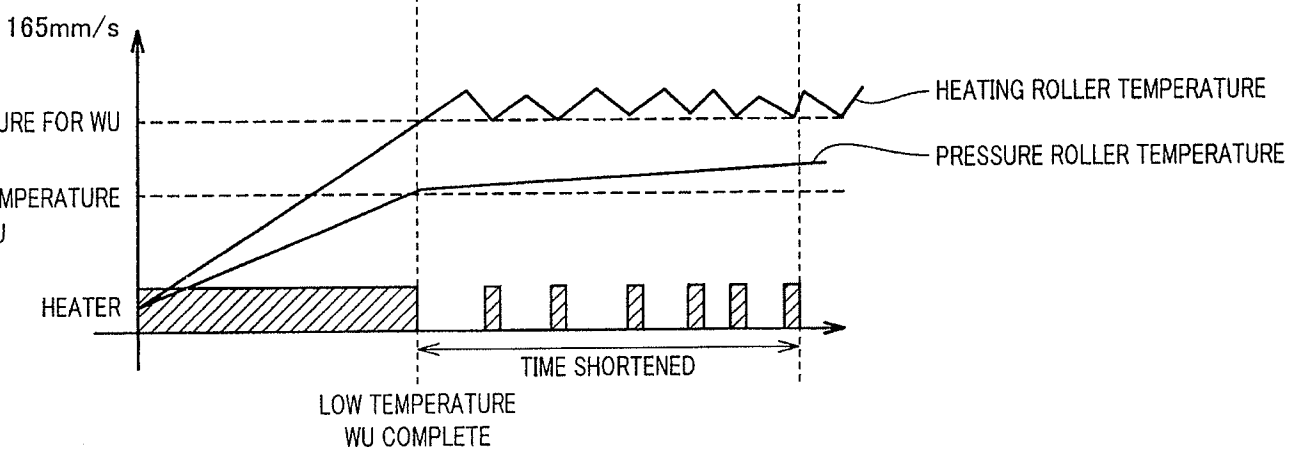
Figure 8A:
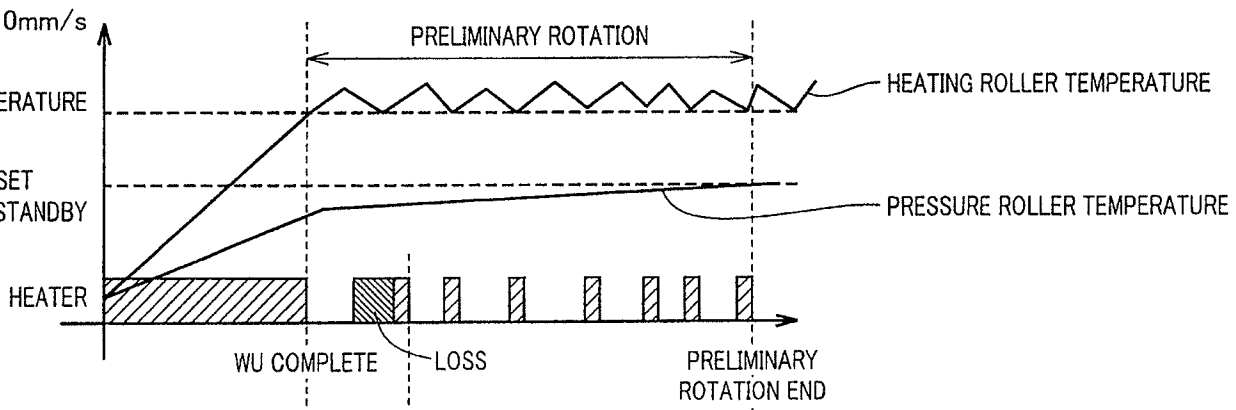
FIGS. 8A and 8B show simulation examples comparing the control method in accordance with an embodiment of the present invention with a conventional control method.
Figure 8B:
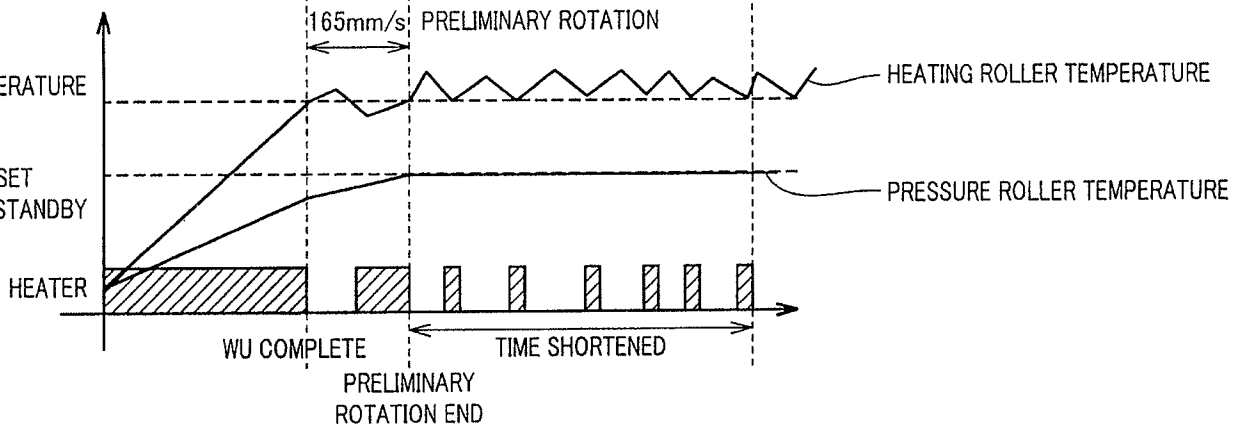

FIGS. 7A, 7B, 8A and 8B show examples of simulation comparing the control method in accordance with the present embodiment with the conventional control method. FIGS. 7A and 7B represent behavior in a warm-up operation from a low-temperatures state, and FIGS. 8A and 8B represent behavior at a transition from the completion of warm-up to a standby state.

As shown in FIG. 7A, when the system speed is 110 mm/s (normal value), the temperature of heating side (heating roller 51) reaches the set value (heating side set temperature for warm-up (WU)) before the pressurizing side attains to a sufficiently high temperature. Therefore, by the temperature adjusting function, a time period in which electric power is not supplied to heater 55 (power off period) is provided. This period is a loss period in which pressure roller 54 cannot sufficiently be heated. Thus, it takes longer for the surface temperature of pressure roller 54 to reach the target temperature (pressurizing side set temperature for low-temperature warm-up).

In contrast, if the system speed is set to 165 mm/s as shown in FIG. 7B, while the system speed increases, the rate of temperature increase of heating side (heating roller 51) lowers. The amount of heat transfer, however, increases as the heating area of heating roller 51 on pressure roller 54 increases and, therefore, the rate of temperature increase of pressure roller 54 improves. Further, as the rate of temperature increase of heating roller 51 lowers, the time until the temperature of heating side (heating roller 51) reaches the set value (heating side set temperature for warm-up (WU)) becomes longer and, therefore, heating roller 51 can generate heat for a longer period than when the system speed is 110 mm/s. Specifically, the loss period in which heater 55 of heating roller 51 is off, experienced when the system speed was 110 mm/s, can be eliminated.

In this manner, according to the present embodiment, pressure roller 54 can be heated efficiently even during warm-up in a low-temperature environment.

Further, as shown in FIGS. 8A and 8B, in a preliminary rotation mode to have heating roller 51 and pressure roller 54 attain to a standby temperature after completion of normal warm-up, efficient heating is possible by changing the system speed in the similar manner as described above.

Specifically, FIGS. 8A and 8B show an example in which warm-up is executed for a prescribed period to heat heating roller 51 and pressure roller 54, and thereafter a preliminary heating operation is executed until the rollers reach the standby temperature.

FIGS. 8A and 8B show examples in which the system speed at the time of warm-up is 110 mm/s. FIGS. 8A and 8B show examples in which, after the completion of warm up (WU complete), in order to raise the surface temperatures of the rollers to respective standby temperatures, the system speed after entering the mode (preliminary rotation mode) for continuing temperature increasing operation (rotation) was set to the normal speed of 110 mm/s (FIG. 8A), and the system speed was changed to a higher speed of 165 mm/s (FIG. 8B).

When we compare FIGS. 8A and 8B, it can be seen that the amount of heat transfer increases as the heating area of heating roller 51 with respect to pressure roller 54 increases, and pressure roller 54 can be heated efficiently, in the similar manner as described above. Therefore, the time necessary for pressure roller 54 to reach the standby temperature (pressurizing side set temperature for standby) can be made shorter.

In this manner, at the time of warm-up and/or in the mode for transition from the completion of warm-up to the standby temperature, it becomes possible to heat pressure roller 54 with higher efficiency and thereby to increase the temperature to the target temperature in a shorter time period, by increasing the system speed to be higher than the normal speed.

(e4: Example 2)

Figure 9:
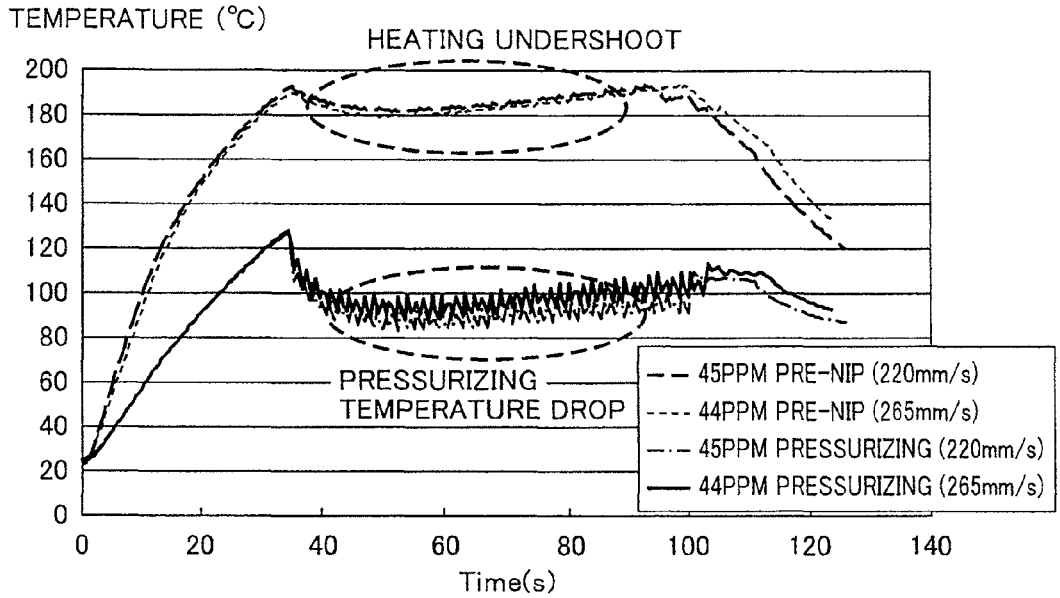
FIG. 9 shows a result of an experiment evaluating temperature drop in the control method in accordance with an embodiment of the present invention.

FIG. 9 shows a result of experiment evaluating temperature drop in accordance with the control method of the present embodiment. Specifically, FIG. 9 shows time change of the temperature of fixing belt 53 before entering nip portion 57 (we-nip) and the surface temperature of pressure roller 54 (pressure), when system speed was set to 220 mm/s and 265 mm/s and sheet-to-sheet-distance was changed to attain substantially the same yield of printing.

The temperature adjusting functions on the heating side (heating roller 51 and fixing roller 52) were the same, and the temperature of heating roller 51 was maintained substantially constant independent of the system speed. Specifically, the two examples had substantially the same degree of temperature undershoot of heating roller 51 related to feeding of media. Nevertheless, when the system speed was 265 mm/s, the surface temperature drop of pressure roller 54 could be improved by about 10° C., than when the system speed was 220 mm/s.

If the temperature difference between heating roller 51 (fixing roller 52) and pressure roller 54 becomes larger, temperature difference between the front side and the backside of a sheet becomes larger and, therefore, the sheet tends to curl tighter. Therefore, by controlling the system speed and the sheet-to-sheet distance such that the temperature difference between the heating side and the pressurizing side becomes smaller, the effect of preventing a curl can be attained while maintaining the yield.

[F. Process Procedure]

Next, process procedure related to the control method as above will be described.

Figure 10:
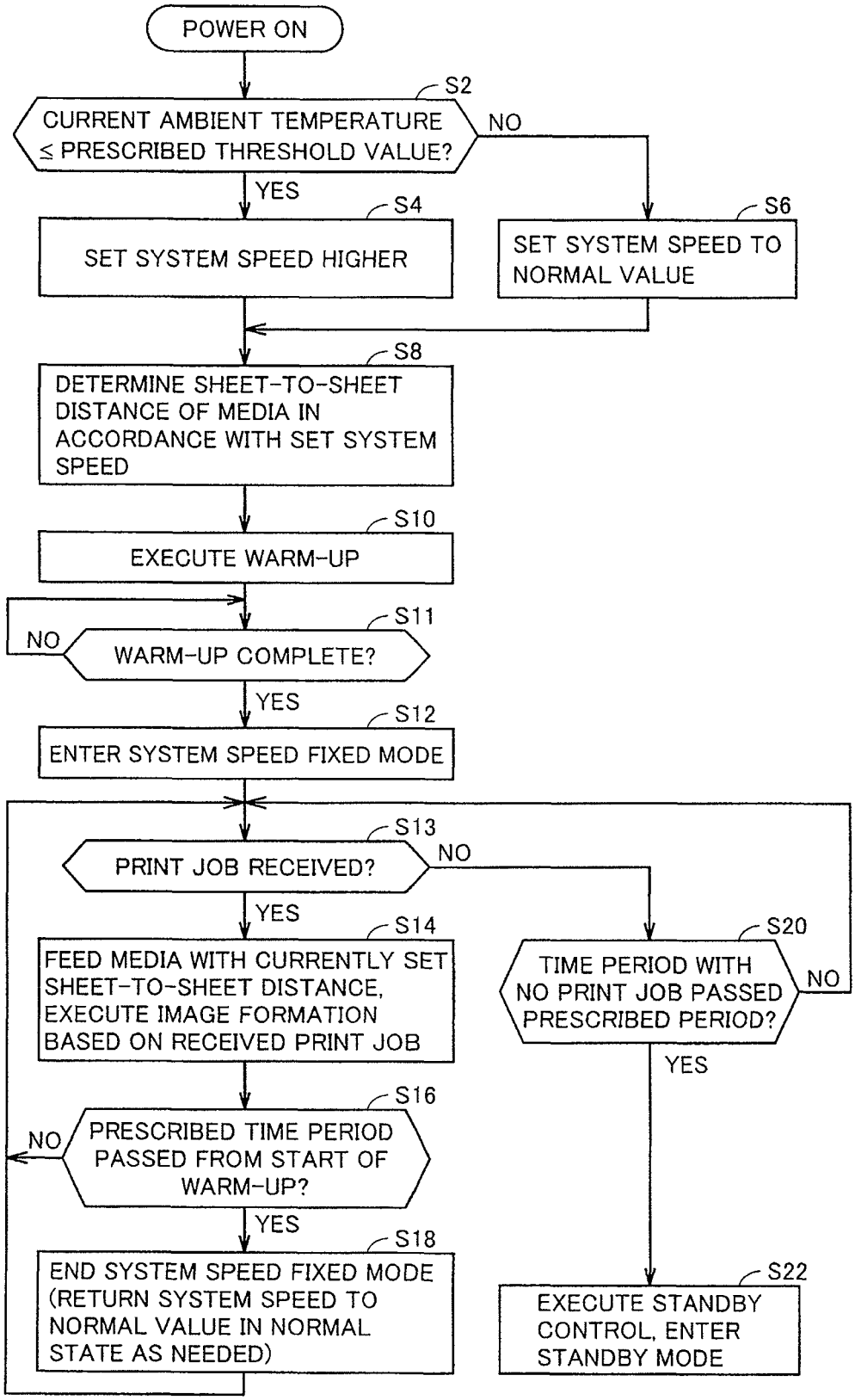
FIG. 10 is a flowchart representing process steps executed at the time of power on in the image forming apparatus in accordance with an embodiment of the present invention.
Figure 11:
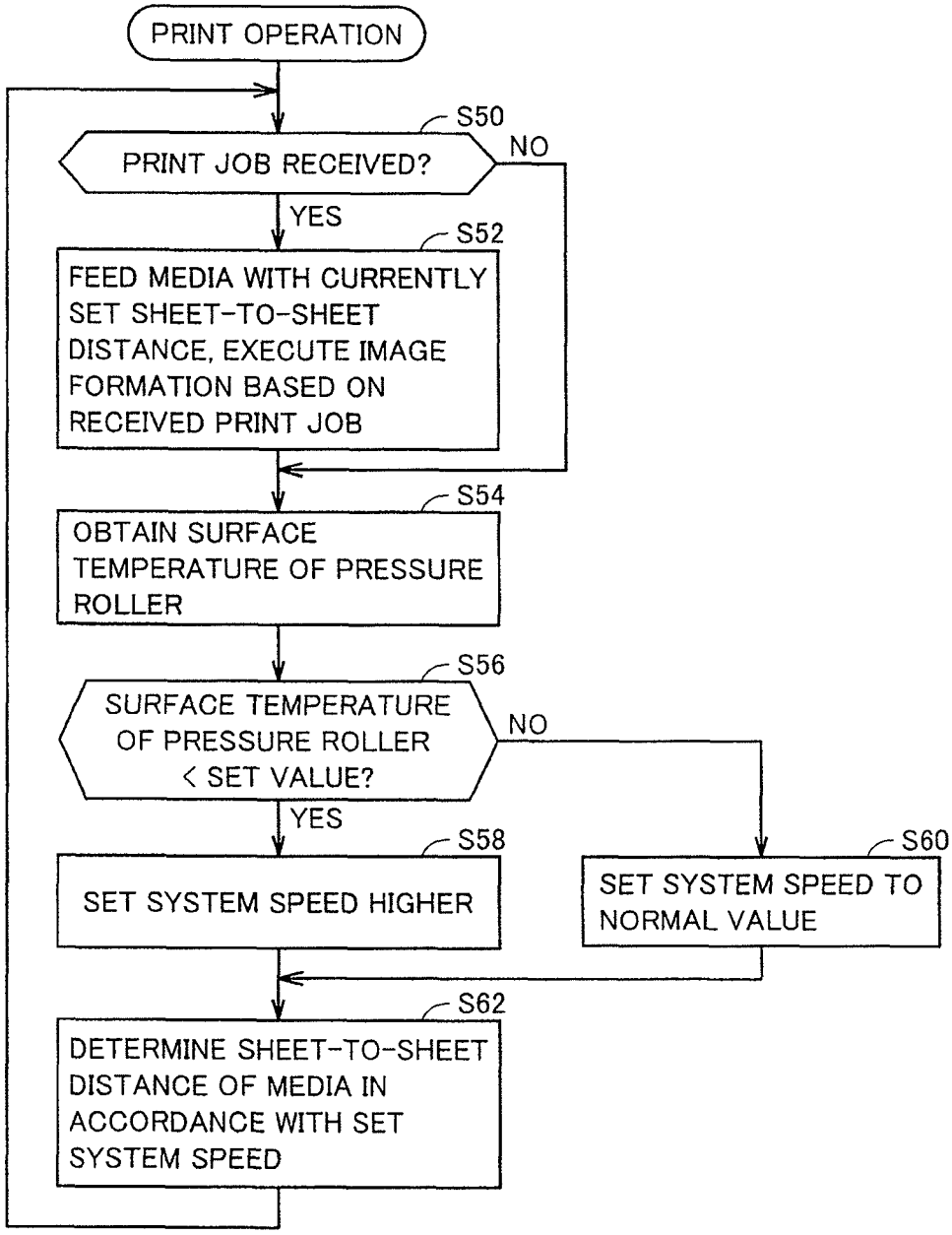
FIG. 11 is a flowchart representing process steps executed during a printing operation in the image forming apparatus in accordance with an embodiment of the present invention.

FIG. 10 is a flowchart representing the process procedure executed at the time of power on in image forming apparatus 100 in accordance with the present embodiment. FIG. 11 is a flowchart representing the process procedure executed at the time of printing in image forming apparatus 100 in accordance with the present embodiment. Each of the steps shown in FIGS. 10 and 11 is provided by a CPU in controller 6 (FIG. 1) executing a program.

(f1: Power on)

Referring to FIG. 10, when the power is turned on, the warm-up operation will be started. Before the start, controller 6 determines the system speed for the warm-up operation. More specifically, controller 6 determines whether or not the current ambient temperature is equal to or lower than a prescribed threshold value (for example, 18° C.) (step S2). If the current ambient temperature is equal to or lower than the prescribed threshold value (YES at step S2), controller 6 determines that the apparatus is now in a low-temperature environment, and sets the system speed to a value (for example, 165 mm/s) higher than the normal value (for example, 110 mm/s) in a normal environment (step S4). On the other hand, if the current ambient temperature exceeds the prescribed threshold value (NO at step S2), controller 6 determines that the apparatus is now in a normal environment, and sets the system speed to the normal value (for example, 110 mm/s) in the normal environment (step S6).

After the system speed is determined in this manner, controller 6 determines the sheet-to-sheet distance of media, in accordance with the set system speed (step S8).

Thereafter, controller 6 executes the warm-up operation (step S10).

Then, controller 6 determines whether or not the warm-up operation is completed (step S11). Whether the warm-up operation is completed or not may be determined by determining whether a prescribed time period (for example, one or two minutes) has passed, or by determining whether or not the heating roller has reached a prescribed temperature.

Then, after the completion of warm-up, controller 6 makes a transition to a system speed fixed mode in which the operation is done with the system speed fixed for a prescribed time period (step S12).

Thereafter, controller 6 determines whether or not a print job is received (step S13). If a print job is received (YES at step S13), controller 6 feeds the media with the currently set sheet-to-sheet distance, and executes the image forming process based on the received print job (step S14).

Thereafter, controller 6 determines whether or not a prescribed time period (for example, 5 minutes) has passed from the start of warm-up operation (step S16).

If a prescribed time period has passed from the start of warm-up operation (YES at step S16), the system speed fixed mode is terminated. Specifically, the system speed is returned to the normal value for the normal environment as needed (step S18). Specifically, if a prescribed time period has passed from the start of warm-up operation, it is determined that fixing device 5 has been heated sufficiently. Then, it follows that the surface temperature of pressure roller 54 is also sufficiently high. Thus, the system speed is returned to the normal value to avoid excessive heating of pressure roller 54.

If the system speed is changed, the sheet-to-sheet distance of media is also changed. If the prescribed time has not yet passed from the start of warm-up operation (NO at step S16), the process of step S18 is skipped.

Then, the process following step S13 is repeated.

On the contrary, if no print job is received (NO at step S13), controller 6 determines whether or not the time period in which no print job is received has exceeded a prescribed time period (step S20). If the period in which no print job is received has not exceeded a prescribed time period (NO at step S20), the process following step S13 is repeated.

On the other hand, if the period in which no print job is received has exceeded a prescribed period (YES at step S20), controller 6 executes standby control and makes a transition to the standby mode (step S22).

As described above, controller 6 may select a mode with higher system speed, in response to switching of heater 55 as the heat source from non-heat-generating state (stopped state) to a heat-generating state (warm-up state). Further, after the passage of a prescribed time period from the selection of the mode with higher system speed, controller 6 may switch to the mode in which the system speed is returned to the normal value.

It is noted, however, that if the ambient temperature of image forming apparatus 100 is equal to or higher than a prescribed threshold value, controller 6 determines that the apparatus is in a normal environment and, even if heater 55 as the heat source is switched from non-heat-generating state (stopped state) to a heat-generating state (warm-up state), it selects the mode in which the system speed is kept at the normal value.

The system speed fixed mode continues for a prescribed time period after the start of warm-up operation. Even after the prescribed time period, the system speed may be changed appropriately. For example, if pressure roller 54 is not yet heated to the set temperature even after the warm-up operation executed with higher system speed, the higher system speed may be maintained. Alternatively, if pressure roller 54 is not yet heated to the set temperature after the warm-up operation executed with normal system speed, the system speed may be increased to further heat pressure roller 54.

(f2: Printing Operation)

Though the process procedure related to the operation at the time of power on is shown in FIG. 10, the temperature of pressure roller 54 may be regulated also during the printing operation, by additionally providing a temperature sensor 58 (FIG. 2) for measuring the temperature (surface temperature) of pressure roller 54.

Referring to FIG. 11, controller 6 determines whether or not a print job is received (step S50). If a print job has been received (YES at step S50), controller 6 feeds the media with the currently set sheet-to-sheet distance, and executes the image forming process based on the received print job (step S52). If no print job is received (NO at step S52), the process of step S52 is skipped.

Thereafter, controller 6 obtains the surface temperature of pressure roller 54 measured by temperature sensor 58 (step S54). Then, controller 6 determines whether or not the surface temperature of pressure roller 54 obtained at step S54 is lower than a set value (for example, 60° C.) (step S56).

If the surface temperature of pressure roller 54 is lower than the set value (YES at step S56), controller 6 determines that heating of pressure roller 54 is necessary, and sets the system speed to a value (for example, 165 mm/s) higher than the normal value (for example, 110 mm/s) for the normal environment (step S58). On the other hand, if the surface temperature of pressure roller 54 exceeds the set value (NO at step S56), controller 6 determines that further heating of pressure roller 54 is unnecessary, and sets the system speed to the normal value for the normal environment (step S60).

After the system speed is determined in this manner, controller 6 determines the sheet-to-sheet distance for the media, based on the set system speed (step S62).

Then, the process following step S50 is repeated.

In this manner, controller 6 selects the mode in which the system speed is set higher, if the temperature of pressure roller 54 (pressurizing rotating body) is lower than a prescribed value. Then, after selecting the mode of higher system speed, if the temperature of pressure roller 54 (pressurizing rotating body) reaches a prescribed value or higher, controller 6 switches the operation to a mode in which the system speed is returned to the normal value.

[G. Other Aspects]

According to other aspects, the fixing device for the image forming apparatus may be expressed as follows.

Specifically, the fixing device according to an aspect of the present invention is formed of a heat source, a heating rotating body having a temperature detecting device, and a pressurizing rotating body provided to form a nip portion by applying load to the heating rotating body. The fixing device fixes the toner on the medium, by the heat from heating roller and the load from pressure roller. Until a prescribed time period from the start of warm-up, speed of rotation of rotating bodies is set higher and the space between media is made wider, and after the prescribed time period, the speed of rotation is decreased and the space between the media is made narrower, so that yield per unit time is substantially kept constant in both situations.

Further, the fixing device according to another aspect of the present invention is formed of a heat source, a heating rotating body having a temperature detecting device, and a pressurizing rotating body provided to form a nip portion by applying load to the heating rotating body. The fixing device fixes the toner on the medium, by the heat from heating roller and the load from pressure roller. If the temperature of pressurizing rotating body is lower than a prescribed temperature, speed of rotation of rotating bodies is set higher and the space between media is made wider, and if the temperature is equal to or higher than the prescribed temperature, the speed of rotation is decreased and the space between the media is made narrower, so that yield per unit time is substantially kept constant in both situations.

[H: Advantages]

According to the present embodiment, in an environment in which pressure roller temperature tends to decrease and severe curling or low-temperature offset is expected, the system speed and sheet-to-sheet distance are controlled such that the heat on the heating side is positively transferred to the pressurizing side, while ensuring comparative yield as in the normal environment. Thus, the surface temperature drop of pressure roller is prevented.

Though the rate of temperature increase on the heating side is moderate, since the system speed during the warm-up operation is increased, much heat can be transferred from the heating side to the pressurizing side and, therefore, the time necessary for warm-up can be made shorter and yield can be maintained.

By appropriately controlling the system speed and the sheet-to-sheet distance as described above, the surface temperature drop of pressure roller can be prevented and good fixing characteristic can be maintained, without necessitating the method of elongating warm-up time, increasing set values related to temperature control or reducing yield immediately after activation.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus, comprising:

an image forming section for forming a toner image on a medium;

a heat source;

a fixing rotating body receiving heat supplied from said heat source;

a pressurizing rotating body adapted to form a nip portion with said fixing rotating body;

a feeding section for feeding said medium at a speed synchronized with circumferential speed of said fixing rotating body and said pressurizing rotating body, so that said medium having said toner image formed thereon passes through said nip portion;

a temperature adjusting section for controlling an amount of heat generated by said heat source so that temperature of said fixing rotating body attains to a prescribed value; and a control section for switching between a first mode in which said fixing rotating body and said pressurizing rotating body rotate at a first circumferential speed and said medium is fed to said image forming section at a first distance interval, and a second mode in which said fixing rotating body and said pressurizing rotating body rotate at a second circumferential speed higher than said first circumferential speed and said medium is fed to said image forming section at a second distance interval longer than said first distance interval, wherein a time cycle for feeding said medium in said first mode to said image forming section and a time cycle for feeding said medium in said second mode to said image forming section are the same so as to achieve a constant number of prints output per unit time.

2. The image forming apparatus according to claim 1, wherein said control section selects said second mode in response to switching of said heat source from a state not generating any heat to a heat generating state.

3. The image forming apparatus according to claim 2, wherein said control section switches to said first mode a prescribed time period after selection of said second mode.

4. The image forming apparatus according to claim 2, wherein said control section selects said first mode even if said heat source is switched to the heat generating state, as long as ambient temperature of said image forming apparatus is at a prescribed value or higher.

5. The image forming apparatus according to claim 1, further comprising a temperature measuring section for measuring temperature of said pressurizing rotating body; wherein said control section selects said second mode if the temperature of said pressurizing rotating body is lower than a prescribed value.

6. The image forming apparatus according to claim 5, wherein after selecting said second mode, if the temperature of said pressurizing rotating body attains to said prescribed value or higher, said control section switches to said first mode.

7. The image forming apparatus according to claim 1, wherein a relation between said first circumferential speed and said second circumferential speed fulfills the following:

said first circumferential speed:said second circumferential speed=(length of medium+sheet-to-sheet distance in said first mode):(length of medium+sheet-to-sheet distance in said second mode).

8. An image forming method of forming a toner image on a medium, comprising the steps of:

forming a toner image on said medium;

feeding said medium with said toner image formed thereon, at a speed synchronized with circumferential speed of a fixing rotating body and a pressurizing rotating body, to be passed through a nip portion formed between said pressurizing rotating body and said fixing rotating body receiving heat supplied from a heat source;

controlling an amount of heat generated by said heat source so that temperature of said fixing rotating body attains to a prescribed value; and switching between a first mode in which said fixing rotating body and said pressurizing rotating body rotate at a first circumferential speed and said medium is fed to an image forming section at a first distance interval, and a second mode in which said fixing rotating body and said pressurizing rotating body rotate at a second circumferential speed higher than said first circumferential speed and said medium is fed to said image forming section at a second distance interval longer than said first distance interval, wherein a time cycle for feeding said medium in said first mode to said image forming section and a time cycle for feeding said medium in said second mode to said image forming section are the same so as to achieve a constant number of prints output per unit time.

9. The image forming method according to claim 8, wherein said step of switching includes the step of selecting said second mode in response to said heat source being switched from a state not generating any heat to a heat generating state.

10. The image forming method according to claim 9, wherein said step of switching includes the step of switching to said first mode a prescribed time period after selection of said second mode.

11. The image forming method according to claim 9, wherein said step of switching includes the step of selecting said first mode even if said heat source is switched to the heat generating state, as long as ambient temperature of said image forming apparatus is at a prescribed value or higher.

12. The image forming method according to claim 8, further comprising the step of measuring temperature of said pressurizing rotating body; wherein said step of switching includes the step of selecting said second mode if the temperature of said pressurizing rotating body is lower than a prescribed value.

13. The image forming method according to claim 12, wherein said step of switching includes the step of switching to said first mode, after selecting said second mode, if the temperature of said pressurizing rotating body attains to said prescribed value or higher.

14. The image forming method according to claim 8, wherein a relation between said first circumferential speed and said second circumferential speed fulfills the following:

said first circumferential speed:said second circumferential speed=(length of medium+sheet-to-sheet distance in said first mode):(length of medium+sheet-to-sheet distance in said second mode).

* * * * *